US005301998A

United States Patent [19]

Davis

[11] Patent Number: 5,301,998

[45] Date of Patent: Apr. 12, 1994

[54] FOLDABLE FURNITURE

[76] Inventor: Owen M. Davis, 5576 Cabin John Dr., Virginia Beach, Va. 23464

[21] Appl. No.: 997,508

[22] Filed: Dec. 28, 1992

[51] Int. Cl.[5] ..... A47B 39/00

[52] U.S. Cl. ..... 297/135; 297/17

[58] Field of Search ..... 297/135, 17, 16, 31, 297/139, 184, 188; 5/417, 420

[56] References Cited

U.S. PATENT DOCUMENTS

| | | | |
|---|---|---|---|
| 3,494,661 | 2/1970 | Leyburn | 297/188 |
| 3,994,527 | 11/1976 | Nikitits et al. | 297/139 X |
| 4,742,900 | 5/1988 | Boxhammer | 297/17 X |
| 4,773,708 | 9/1988 | Nastu | 297/17 X |
| 4,789,200 | 12/1988 | Munguia | 297/184 |
| 5,042,874 | 8/1991 | Williams | 297/17 |

FOREIGN PATENT DOCUMENTS

| | | | |
|---|---|---|---|
| 2400873 | 4/1979 | France | 5/417 |

*Primary Examiner*—Peter M. Cuomo
*Assistant Examiner*—Jerry Redman
*Attorney, Agent, or Firm*—Stephen E. Clark

[57] ABSTRACT

Pair of foldable lounge seats are connected along their respective inboard sides to a table panel positioned between the two lounge seats. Convex depression in the top of each lounge seat panel accommodates collapsing of hinged seat back rest. Lounge seats and table panel are foldable into a compact rectangular shape. Carrying strap is provided for transporting the collapsed device. Opening through table panel accommodates umbrella pole, which is used to secure device to ground when in use. Umbrella retaining straps are provided on the outboard surface of the collapsed device for easy transporting of the device together with an umbrella.

8 Claims, 8 Drawing Sheets

FOLDABLE FURNITURE

FIELD OF INVENTION

The present invention relates to chairs and seats. More particularly the present invention relates to collapsible chairs.

BACKGROUND

It is a well known problem that when persons spend a recreational day at the beach, the site is typically some considerable distance away from the persons' transportation. In addition, it if frequently desirable to take to the beach various items such as beach chairs, umbrellas, tables and assorted sundries such as towels and sun tan lotion. Many prior designs of beach furniture are known which have addressed the problems associated with transporting these various apparatus from the car to the beach. Accordingly, most prior beach furniture designs generally comprise folding rigid frames which support light-weight webbing.

A problem with such prior devices is that, although they can be somewhat folded up they typically do not sufficiently collapse for convenient storage and transport. In addition, while prior individual beach chairs can be folded, typically only individual chairs fold up, thus making it cumbersome to carry more than one such chair, particularly if it is desired, at the same time, to carry an umbrella.

OBJECTS

Accordingly, it is a primary object of the present invention to provide a light-weight collapsible beach chair which may be collapsed into a relatively low-profile, substantially flat package.

It is another object to provide an embodiment of the present invention of the character described in which a pair of beach chairs are permanently attached to each other by a hinged, or similar, connection.

It is another object of the present invention to provide a device of the character described in which two beach chairs are permanently attached to a common table therebetween by a hinged, or similar connection.

It is another object of the present invention to provide a device of the character described in which the table is adapted to support an umbrella.

It is another object of the present invention to provide a device of the character described in which the table is provided with cavities which are adapted to receive drinking cups.

It is another object of the present invention to provide a device of the character described which may be easily transported by a single user in its collapsed configuration.

It is another object of the present invention to provide a device of the character described which has a carrying strap attached to at least one side for easy transport in its collapsed configuration.

It is further object to provide an embodiment of the present invention comprising a single beach chair of the character described attached to a collapsible table of the character described.

Further objects and advantages of my invention will become apparent from a consideration of the drawings and ensuing description thereof.

DRAWINGS

DESCRIPTION

Figure 1:
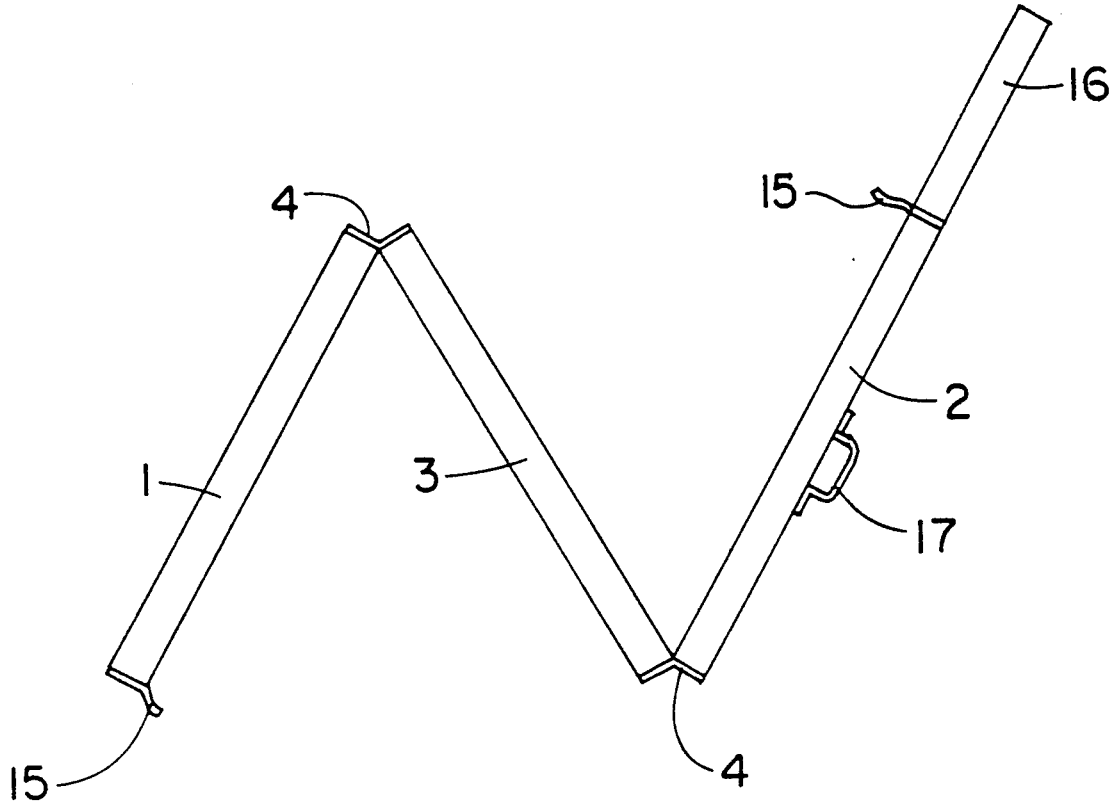
FIG. 1 is a front elevation of the present invention in a partially collapsed configuration.
Figure 2:
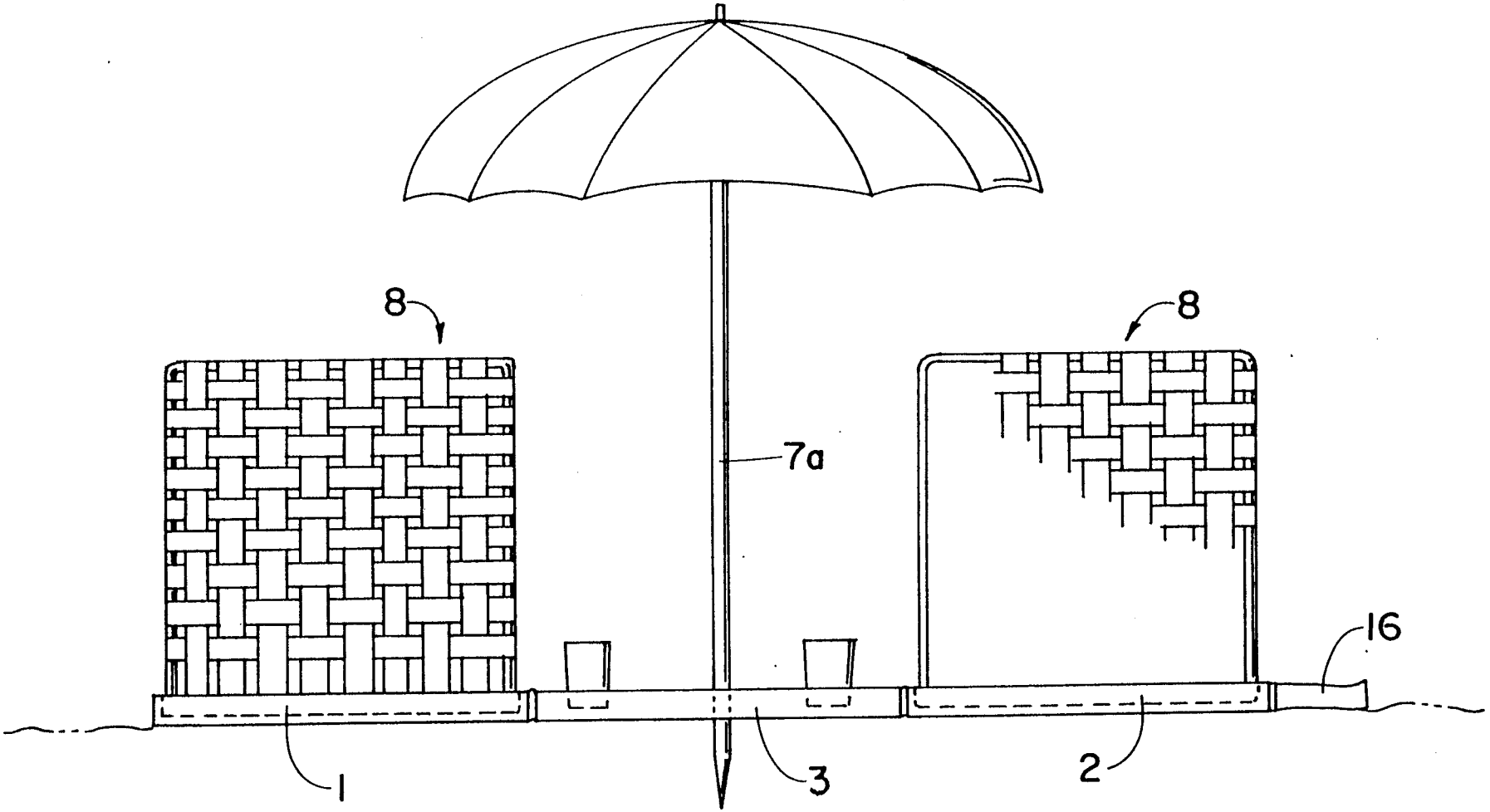
FIG. 2 is a front elevation of the present invention.
Figure 3:
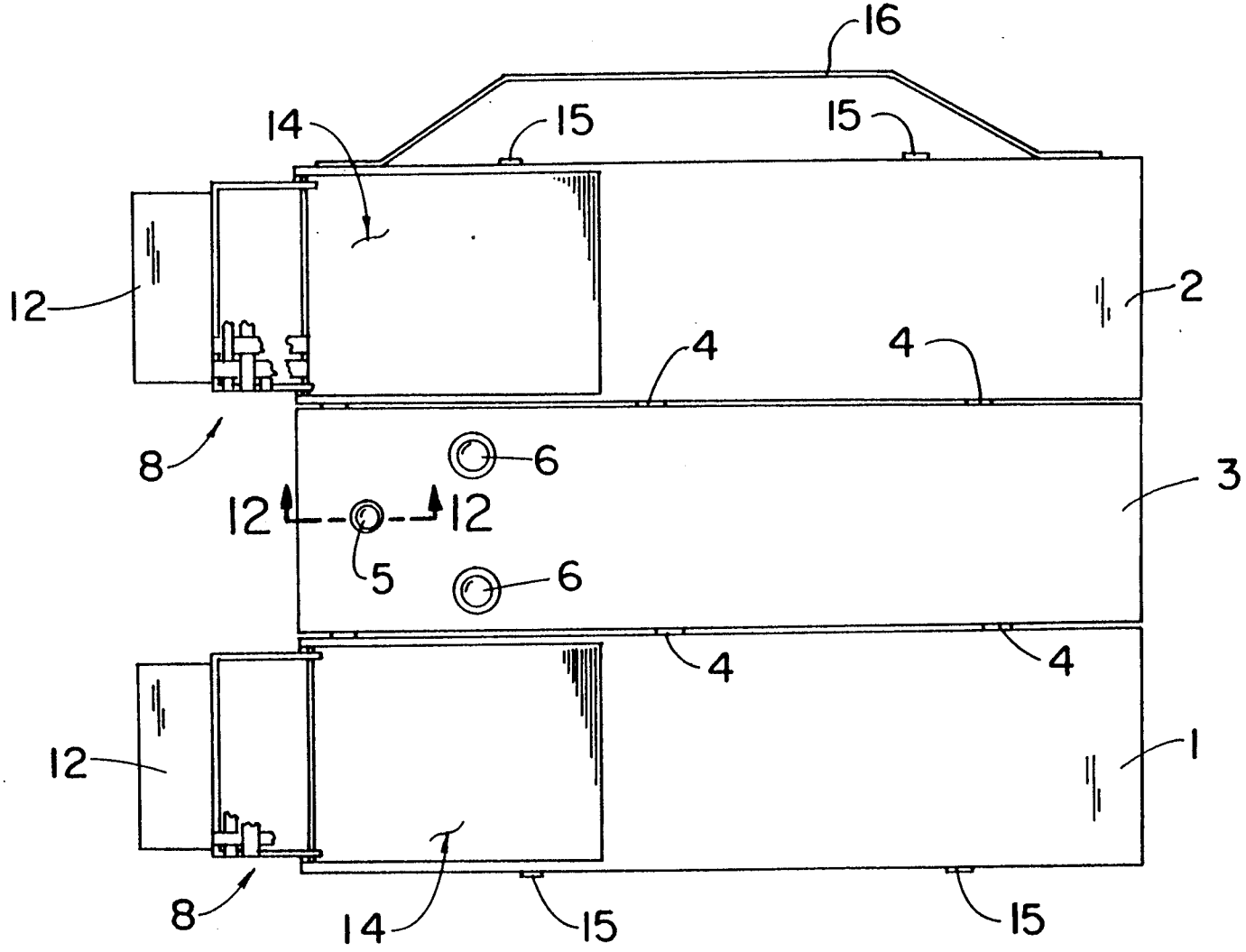
FIG. 3 is a plan view of the present invention.
Figure 4:
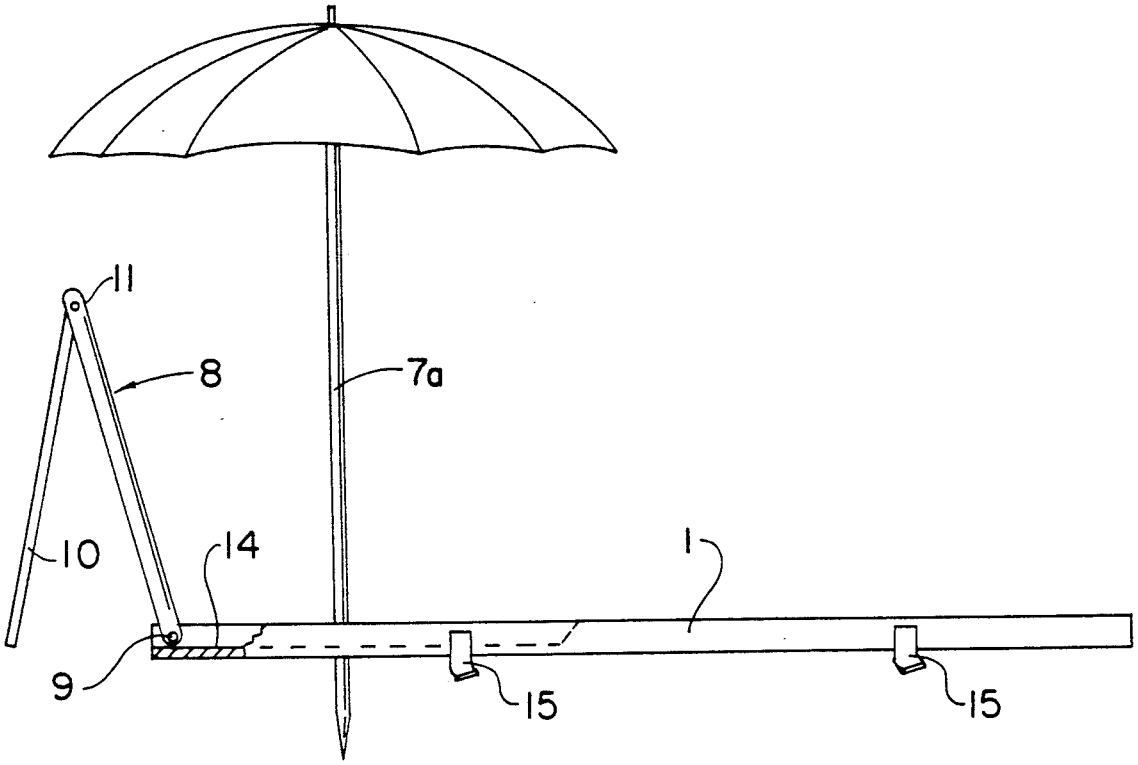
FIG. 4 is a side view of the present invention in an unfolded configuration.
Figure 5:
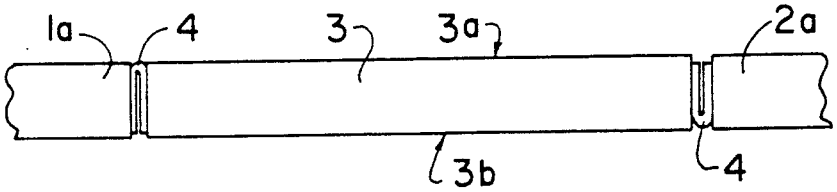
FIG. 5 is a front elevation showing the details of construction of the hinges of the present invention.

In the preferred embodiment of the invention a left-side lounge seat panel 1 and a right-side lounge seat panel 2 are each connected along their interior sides 1*a* and 2*a*, respectively, to a table panel 3 with hinges 4.

The left-side lounge seat panel 1, the right-side lounge seat panel 2 and the table panel 3 are each preferably constructed of light weight, low density foam. Preferably, the lounge seat panels 1 and 2 are non-compressible and are fairly rigid. The left-side lounge seat panel 1, the right-side lounge seat panel 2 and the table panel 3 are each preferably 24 inches wide, 54 inches long and 2.5 inches thick.

The table panel 3 is preferably provided with a circular opening 5 which is suitably sized to accommodate an umbrella pole 7*a*, and a pair of circular openings 6 which are each suitably sized to accommodate drinking cups.

A seat back 8 is attached to the rear end of each of the lounge seat panels 1 and 2, respectively, by a hinged connection 9. The seat backs 8 are each preferably constructed of a low-profile, rigid tubular frame 10 and webbing 11. A back support 12 is attached to the rear of the seat back 8 with a hinged connection 13 between the back support 12 and the tubular frame 10.

A convex seat depression 14 is molded into each of the lounge seat panels 1 and 2, respectively. The seat depression 14 is preferably of size and shape sufficient to allow the seat back 8 and the back support 12 to completely nest within the seat depression 14 when the apparatus is in its collapsed configuration.

VELCRO fasteners 15 are preferably provided at the sides of the lounge seat panels 1 and 2, respectively, so that the sides of the lounge seat panels may be temporarily secured to each other when the apparatus is in the collapsed configuration. A carrying handle 16 is attached to the outboard side of the left-side lounge seat panel 2 to facilitate carrying of the apparatus when it is in the collapsed configuration. An pair of umbrella support straps 17 are attached to the underside of the left-side lounge seat panel 2 to facilitate carrying an umbrella 7 when the apparatus is in its collapsed configuration.

OPERATION

When in use the right-side lounge seat panel 1, the left side lounge seat panel 2 and the table panel 3 are unfolded and each laid flat upon the ground. The seat backs 8 are each unfolded, pivoting about a hinged connection 9 at the rear of the lounge seat panels 1 and 2, respectively. The back support 12 is unfolded from the seat back 8 and advantageously positioned so as to provide the desired angle of incline between the seat back 8 and the lounge seat panels.

When in use a person sits upon the lounge seat panel with his back against the seat back 8 and his legs rest upon either the lounge seat panel (1 or 2).

An umbrella pole *7a* may be inserted through the circular opening 5 in the table panel 3. In addition to providing shade for the user, it will be appreciated that the umbrella 7 helps secure the apparatus in place, preventing its being dislocated, for example, by the wind.

The table panel 3 provides a convenient surface upon which to place items which it may be desirable to keep off of the ground, such as food, clothing and sundries. Beverage containers may be conveniently stored in the circular openings 6 in the table panel 3. In addition to providing a convenient storage receptacle for beverages, when cups or other containers are paced in these openings 6 they are protected from spillage due to being accidently knocked over. In the preferred embodiment of the invention, the beverage cup openings 6 in the top of the table panel do not extend all the way through the table panel. That is: the beverage cup openings 6 are preferably molded depressions in the top surface of the table panel 3. It will be appreciated that this construction provides a convenient receptacle in the table panel 3 for beverage containers, but does not allow such containers to become soiled or sandy by the ground beneath the table panel.

Figure 6:
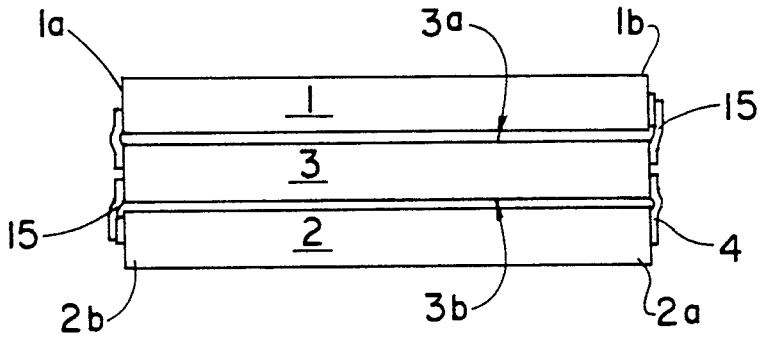
FIG. 6 is a front elevation of the present invention in a collapsed configuration.
Figure 7:
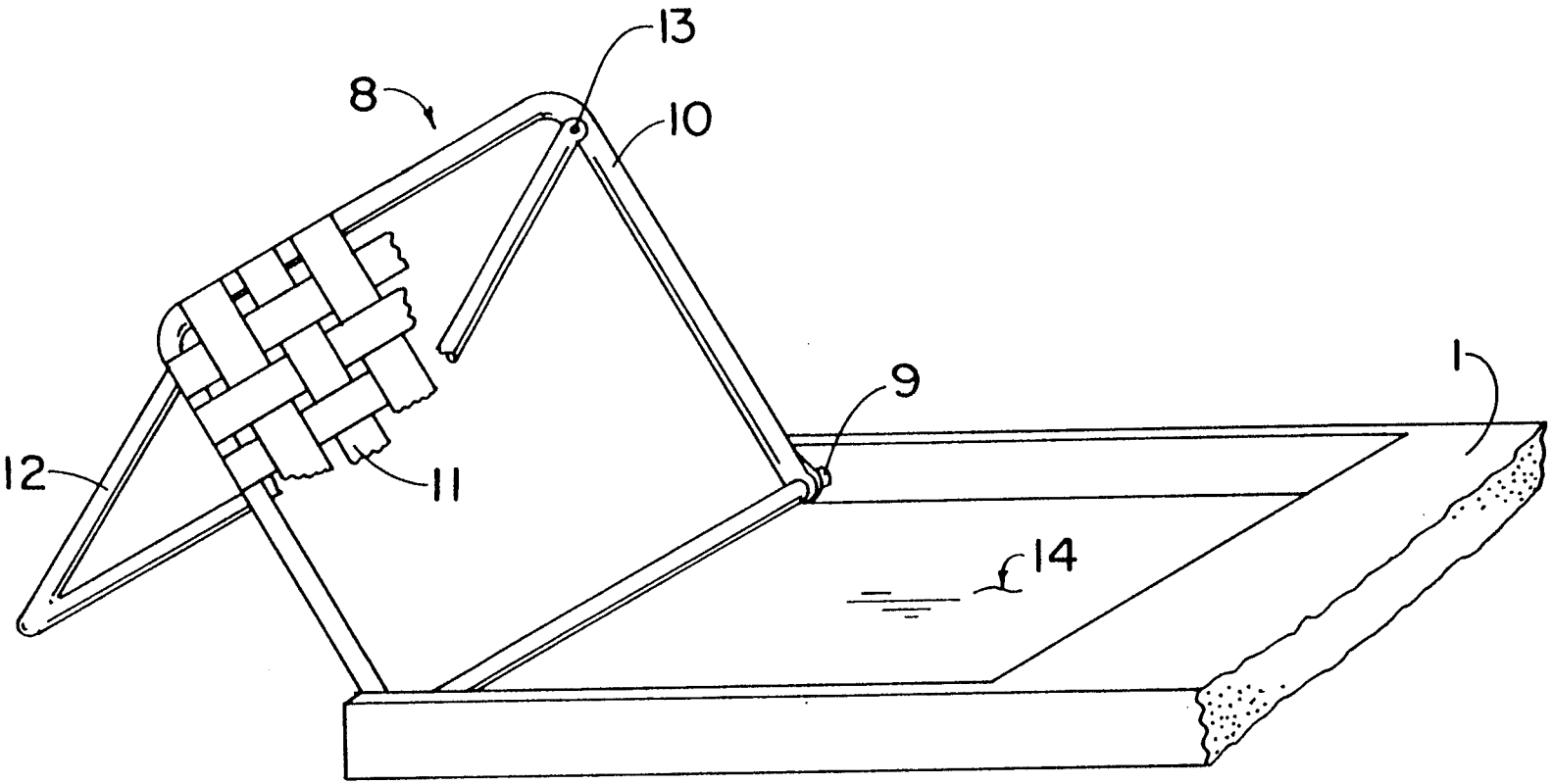
FIG. 7 is a perspective view showing the details of construction of the seat back.
Figure 8:
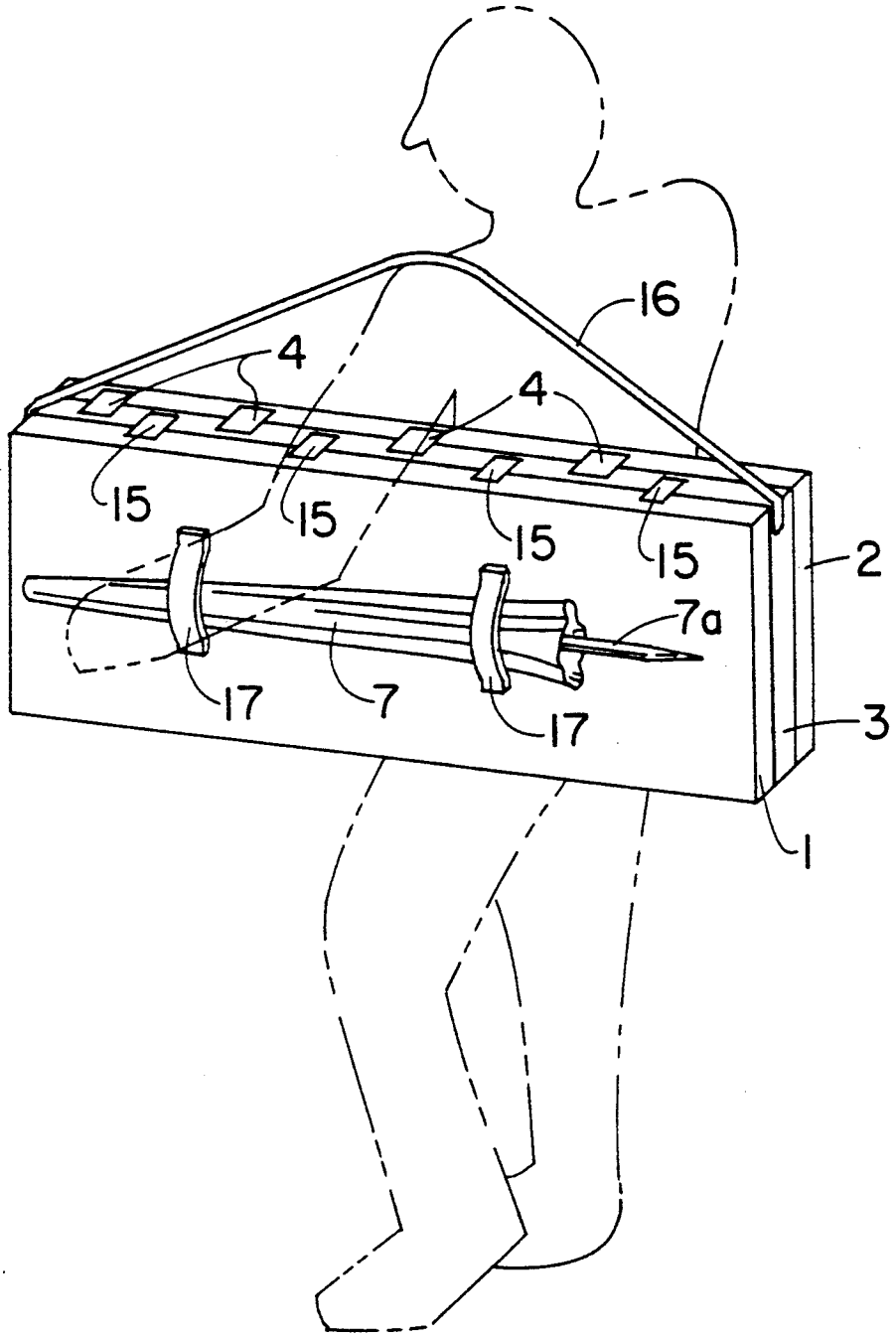
FIG. 8 is a perspective view of the present invention in its collapsed configuration, showing the apparatus being carried by a person.

When it is desirable to transport the apparatus, the umbrella pole 7 is removed from the circular opening 5 in the table panel 3; the seat backs 8 and back supports 12 are folded down into the convex seat depressions 14 in the lounge seat panels 1 and 2; and the two lounge seat panels 1 and 2, are folded in opposite directions against the top *3a* and bottom *3b* of the table panel, respectively, (as shown in FIGS. 6 and 8). VELCRO fasteners 15 are used to secure adjacent panel members (1, 2 and 3) to each other. An umbrella 7 may be inserted in the umbrella straps 17. The entire apparatus may be easily carried in its collapsed configuration by supporting the carrying strap 16, for example from a person's shoulder (as shown in FIG. 8).

It will be appreciated by those skilled in the art that the apparatus constructed in accordance with the preferred embodiment of the invention provides a lightweight, low profile combination of two lounge chairs and a table surface which can be easily collapsed for transport and storage. It will also be understood from a review of the specification that an apparatus constructed in accordance with the preferred embodiment of the invention can be folded into a substantially rectangular package having the outside dimensions of 54 inches by 24 inches by 7.5 inches.

Figure 10:
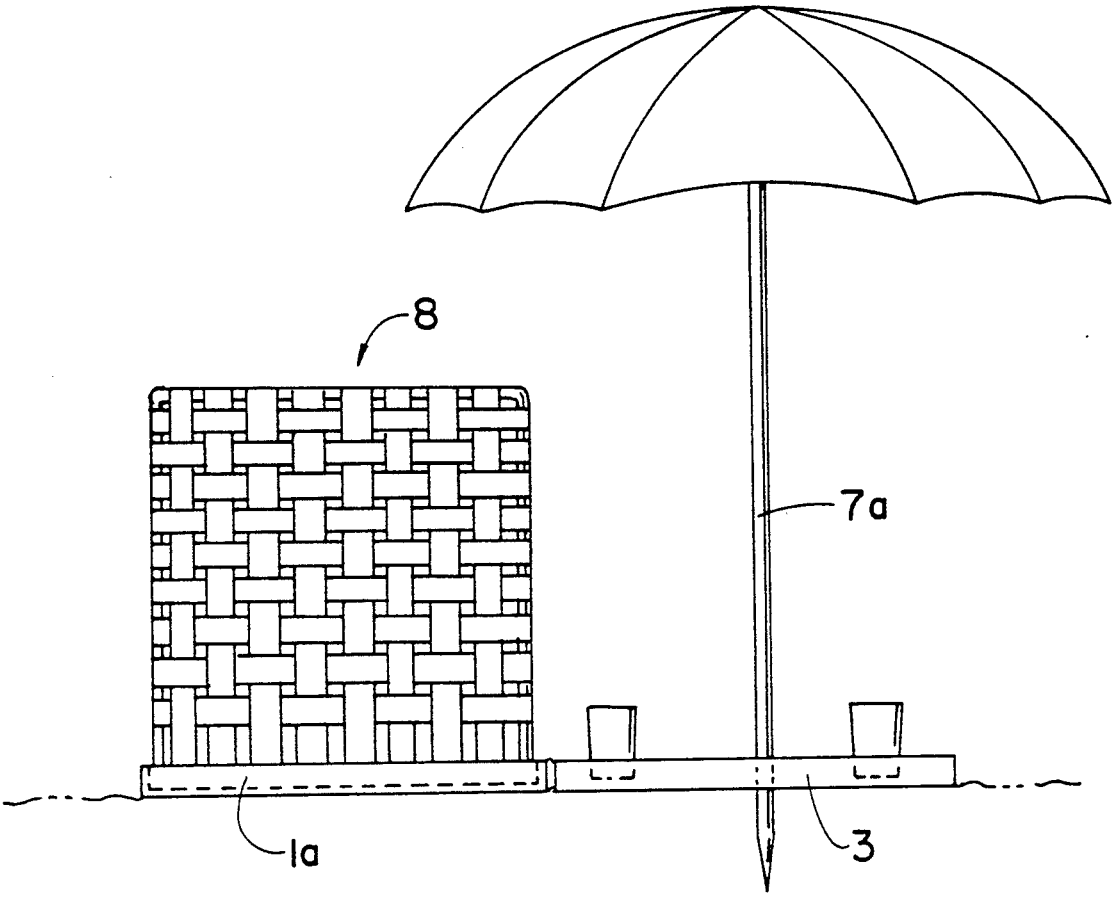
FIG. 10 is a front elevation of the modification of the present invention shown in FIG. 9.
Figure 9:
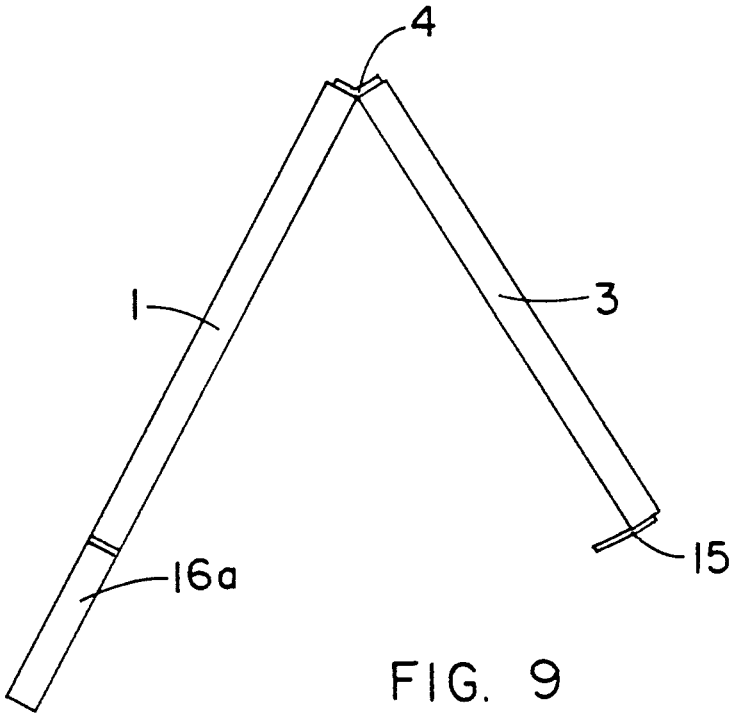
FIG. 9 is a front elevation of a modification of the present invention is a partially collapsed configuration.
Figure 11:
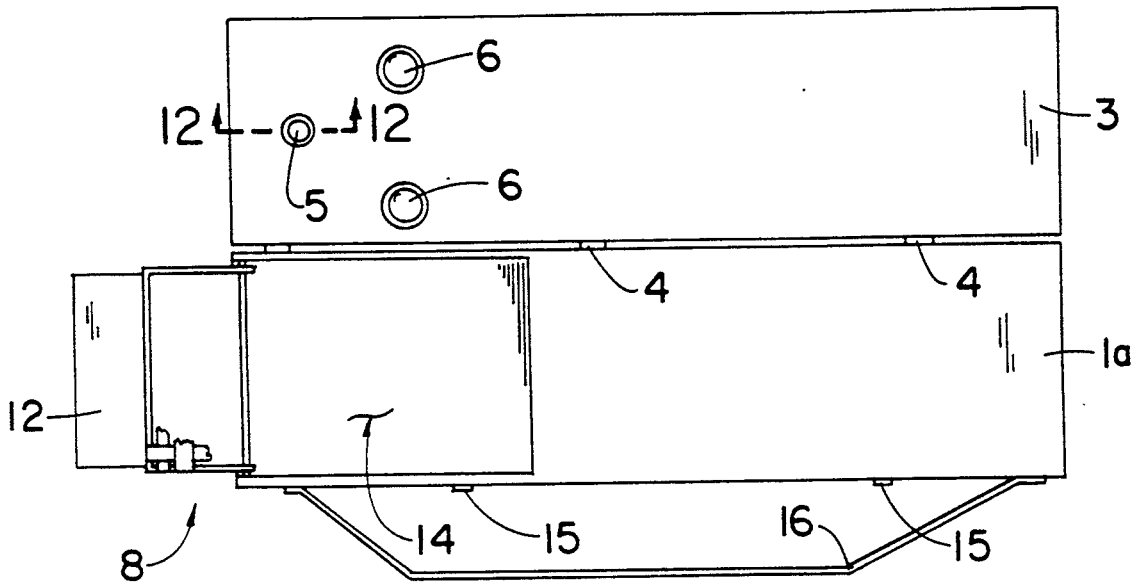
FIG. 11 is a plan view if the modification of the present invention shown in FIG. 9.
Figure 12:
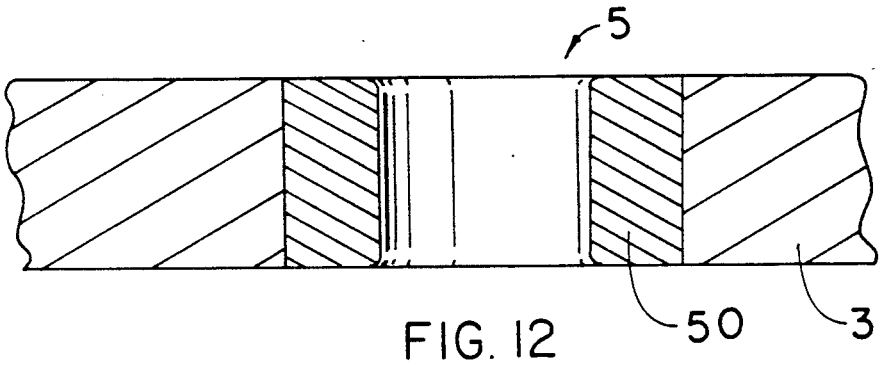
FIG. 12 is a sectional view showing details of the compressible collar, taken along the line 12—12 of FIG. 3.

An important modification of the preferred embodiment of the invention is illustrated in FIGS. 9, 10 and 11. In this modification of the invention a single lounge seat panel *1a* is attached to the table panel 3, in the manner described according to the preferred embodiment of the invention. In FIGS. 9 and 10 and 11, the single lounge seat panel *1a* is shown on the attached to the right side of the table panel 3, but it is understood that the lounge seat panel could alternatively constructed attached to the left side of the table panel. In this modification of the invention the carrying handle *16a* is preferably attached to the outboard side of the lounge seat panel *1a*.

In the preferred embodiment of the invention, a compressible collar 50 is permanently secured within the circular opening 5 in the table panel 3. The compressible collar 50, which may be constructed of rubber, foam, or similar compressible materials, preferably has a sightly smaller inside diameter than the diameter of the smallest umbrella pole *7a* with which device may be used, and a larger outside diameter than the diameter of the largest umbrella pole *7a* with which the device may be used. It will be appreciated that the compressible collar 50 not only secures the table panel 3 to an umbrella pole, but, because it is compressible, it accommodates umbrella poles *7a* of different diameters. In addition, it will be appreciated that the compressible collar 50 allows the umbrella pole *7a* to be inserted through the opening 5 at angles other than perpendicular to the table panel 3, and, accordingly, allows for the umbrella 7 to be tilted as necessary to provide shade while securing the table panel to the umbrella pole *7a*.

Figure 13:
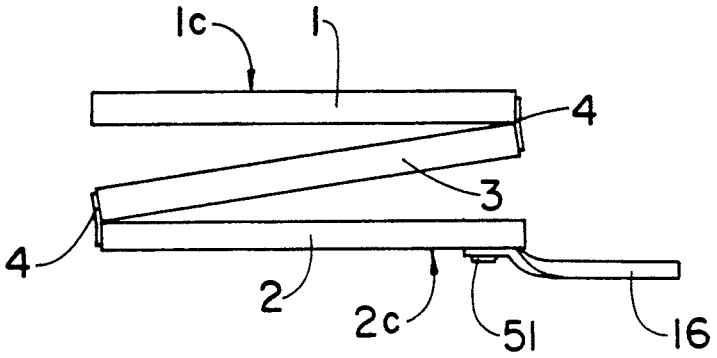
FIG. 13 is a front view of the invention in a partially folded configuration, showing a modified carrying strap construction.

The carrying strap 16 may be attached to the end of the table panel 3, as illustrated in FIG. 8; or to the outboard side of either of the lounge seat panels *1b* or *2b*, respectively, as shown in FIG. 1; or to the bottom side of either the right side lounge panel *1c* or the left side lounge panel *2c*, as illustrated in FIG. 13 The carrying strap 16 may be detachably connected to the device by snap fasteners 51, or their equivalents, as illustrated in FIG. 13.

While the above description contains many specificities, these should not be construed as limitations on the scope of the invention, but rather as an exemplification of one preferred embodiment thereof. Many other variations are possible, for example:

the seat backs 8 can be constructed of light-weight foam board or similar monolithic panels, rather than web-and-tubing;

addition depressions may be provided in the top of the table panel 3, such as to accommodate wallets, coins, and sundries;

the "webbing" of the seat backs 8 can be constructed of fabric, plastic strapping, nylon, or similar materials;

the convex seat depression 14 may extend longitudinally towards the front end (i.e. the foot) of the lounge seat panels beyond the top of the collapsed seat back;

and a compressible cushion may be provided for insertion into the convex seat depression 14;

the hinges 4 between the lounge seat panels and the table panel may be intermittent or continuous, and they may be constructed of single-component flexible fabrics or multiple component clevis and pin-type construction; and the lounge seat panels 1 and 2 may be thicker than the table panel;

and the lounge seat panels and the table panel may be constructed out of any light weight, rigid material;

and the lounge seat panels 1 and 2 may be constructed out of compressible foam material, provided the foam is coated with a stiffener cover, such as plastic or fiberglass;

the hinge connections between the table panel 3 and the lounge seat panels may be detachable, so as to allow for easy conversion from a single lounge seat embodiment to a double lounge seat embodiment, and vice-versa;

and the lounge seat panels 1 and 2 may be constructed from different materials than the table panel.

Accordingly, the scope of the invention should be determined the embodiment illustrated, but by the appended claims and their legal equivalents.

I claim:

1. A folding lounge comprising:

a first base member;

a first back rest member;

and a table member;

said first base member having a first end and a second end opposite to and substantially parallel to said first end, and a first side and a second side substantially parallel to said first side, said first end and said second end of said first base member being relatively shorter than said first side and said second side of said first base member; and said first base member having a top surface and a bottom surface;

wherein said bottom surface of said first base member is substantially rectangular in shape;

and said bottom surface of said first base member is substantially flat;

and said table member has a top surface and a bottom surface, said top surface of said table member being substantially parallel to said bottom surface of said table member, and said top surface of said table member being substantially rectangular in shape, and said top surface of said table member having a first side and a second side;

and further comprising means for attaching said first side of said table member to said first side of said first base member;

wherein said means for attaching said first side of said table member to said first side of said first base member comprises a first hinge connection;

and further comprising means for attaching said first back rest member to said first end of said first base member;

wherein said means for attaching said first back rest member to said first end of said first base member comprises a second hinge connection;

and further comprising a convex depression in said top surface of said first base member, and wherein said first back rest member has a front surface and a rear surface, and a finite thickness as measured between said front surface and said rear surface of said first back rest member;

and wherein the depth of said convex depression in said top surface of said first base member, as measured perpendicular to said top surface of said first base member, is at least as great as said finite thickness of said first back rest member.

2. The device according to claim 1, wherein the length of said first side of said table member is substantially equal to said first side of said base member.

3. The device according to claim 2, further comprising a second base member;

said second base member having a first end and a second end opposite to and substantially parallel to said first end, and a first side and a second side substantially parallel to said first side, said first end and said second end of said second base member being relatively shorter than said first side and said second side of said second base member; and said second base member having a top surface and a bottom surface;

wherein said bottom surface of said second base member is substantially rectangular in shape;

and said bottom surface of said second base member is substantially flat;

and further comprising means for attaching said second side of said table member to said first side of said second base member;

wherein said means for attaching said second side of said table member to said first side of said second base member comprises a third hinge connection;

and further comprising a second back rest member;

and means for attaching said second back rest member to said first end of said second base member;

wherein said means for attaching said second back rest member to said first end of said second base member comprises a fourth hinge connection;

and further comprising a convex depression in said top surface of said second base member, and wherein said second back rest member has a front surface and rear surface, and a finite thickness as measured between said front surface and said rear surface;

and wherein the depth of said convex depression in said top surface of said second base member, as measured perpendicular to said top surface of said second base member, is at least as great as said finite thickness of said second back rest member.

4. The device according to claim 3, wherein:

said first back rest member is foldable into said convex depression in said top surface of said first base member;

and said second back rest member is foldable into said convex depression in said top surface of said second base member.

5. The device according to claim 4, wherein:

said first base member and said table member are relatively foldable such that said bottom surface of said first base member may be temporarily positioned parallel and adjacent to said bottom surface of said table member.

6. The device according to claim 5, wherein said second base member and said table member are relatively foldable, such that said top surface of said second base member may be temporarily positioned parallel and adjacent to said top surface of said table member.

7. The device according to claim 6, further comprising an orifice in said table member;

said orifice extending from said top surface through to said bottom surface in said table member, and being adapted to receive an umbrella staff.

8. The device according to claim 7, further comprising a compressible collar member disposed within said orifice.

* * * * *